US011820463B2

(12) United States Patent
Fenech et al.

(10) Patent No.: US 11,820,463 B2
(45) Date of Patent: Nov. 21, 2023

(54) PONTOON BOAT WITH ONE-WAY TRANSPARENT RAIL AND GATE PANEL

(71) Applicant: BARLETTA BOAT COMPANY, LLC, Bristol, IN (US)

(72) Inventors: William Fenech, Elkhart, IN (US); Jeffrey Roth, South Bend, IN (US)

(73) Assignee: BARLETTA BOAT COMPANY, LLC, Bristol, IN (US)

( * ) Notice: Subject to any disclaimer, the term of this patent is extended or adjusted under 35 U.S.C. 154(b) by 71 days.

(21) Appl. No.: 17/220,702

(22) Filed: Apr. 1, 2021

(65) Prior Publication Data

US 2022/0315168 A1 Oct. 6, 2022

(51) Int. Cl.

| | |
|---|---|
| ***B63B 17/04*** | (2006.01) |
| ***B63B 35/38*** | (2006.01) |
| *B63B 3/48* | (2006.01) |

(52) U.S. Cl.

CPC ..... *B63B 17/04* (2013.01); *B63B 35/38* (2013.01); *B63B 3/48* (2013.01)

(58) Field of Classification Search

CPC ..... B63B 17/00; B63B 17/02; B63B 17/04; B63B 35/00; B63B 35/38; B32B 3/00; B32B 3/10

USPC ..... 114/364

See application file for complete search history.

(56) References Cited

U.S. PATENT DOCUMENTS

| | | | | |
|---|---|---|---|---|
| 5,925,437 | A * | 7/1999 | Nelson | B32B 17/10174 264/156 |
| 6,443,088 | B1 * | 9/2002 | Putman | B63B 17/04 114/364 |
| 7,018,501 | B1 * | 3/2006 | Nelson | G09F 21/04 156/278 |
| 7,897,230 | B2 * | 3/2011 | Ross | B32B 3/10 40/594 |
| 2011/0017965 | A1 * | 1/2011 | Kowalewicz | E04H 17/16 256/19 |

OTHER PUBLICATIONS

Arlon, "Dpf 45WF Vinyl Film—One-Way Vision Digital Print Pressure-Sensitive Film," Brochure, believed to be publicly available prior to Apr. 1, 2021.

* cited by examiner

*Primary Examiner* — Lars A Olson

(74) *Attorney, Agent, or Firm* — Barnes & Thornburg LLP

(57) ABSTRACT

A pontoon boat includes a deck supported by one or more pontoons. A passenger barrier extends upwardly from the deck. The passenger barrier includes a fixed portion and a movable portion. The passenger barrier includes an opaque panel and a one-way transparent panel.

19 Claims, 3 Drawing Sheets

PONTOON BOAT WITH ONE-WAY TRANSPARENT RAIL AND GATE PANEL

BACKGROUND

A pontoon boat typically includes a platform or deck supported by two or more pontoons and a passenger barrier disposed about the perimeter of the deck. Such barriers typically include one or more fixed portions (sometimes referred to as rails) defining one or more openings in the barrier and one more movable portions (sometimes referred to as gates) configured to selectively block the openings. Such barriers typically include at least one gate near the bow of the boat and another gate along a first side of the boat. Such barriers may also include a further barrier along a second side of the boat, and may further include yet another gate near the stern of the boat.

The gates typically are closed when the boat is underway to preclude passengers on the boat from falling off of the deck and into the water. The gates may be opened when the boat is docked or anchored to allow convenient access between the deck and a dock, or between the deck and a swim platform, a ladder, or an underlying body of water.

Such rails and gates typically include a frame and panels covering supported by elements of the frame. Such panels typically are made of opaque materials, for example, aluminum or fiberglass. A drawback to opaque railing and gate panels is that they can obscure the helmsman's view when approaching a dock. As such, it is common practice to open one or more of the gates when approaching a dock to enhance the helmsman's view thereof. This practice requires the helmsman or a passenger to approach and open the gate while the boat is approaching the dock. This practice is unsafe at least because a sudden or unanticipated change in speed of the boat with the door open (or even closed) could cause the helmsman or passenger to lose balance and fall out of the boat. Such a sudden or unanticipated change in speed of the boat could occur as a result of a collision with the dock or grounding of the pontoons in shallow water.

It would be beneficial to improve a helmsman's outward view through the barrier without the need to open a gate.

SUMMARY

In an aspect of the present disclosure, a pontoon boat may include at least two pontoons, a deck supported by the at least two pontoons, and a passenger barrier disposed upon and extending in an upward direction from the deck. The passenger barrier may include a railing defining an opening through the passenger barrier, a gate operable to selectively close the opening, an opaque panel associated with one or the other of the railing and the gate; and a one-way transparent panel associated with one or the other of the railing and the gate.

In embodiments, the one-way transparent panel may include a perforate layer overlying a transparent layer. The perforate layer allows vision therethrough from the transparent layer and substantially blocks vision therethrough toward the transparent layer. A surface of the perforate opaque layer facing away from the transparent layer may be color-matched to the opaque panel. The perforate layer may be disposed on an outward-facing surface of the transparent layer. The perforate layer may include an imperforate portion having a first area and a perforate portion having a second area wherein the second area is about 40% of the first area plus the second area. A surface of the perforate layer facing the transparent layer may be black. A surface of the perforate layer facing away from the transparent layer may be color-matched to the opaque panel. The opaque panel may be associated with the railing, and the one-way transparent panel may be associated with the gate.

In another aspect of the present disclosure, a pontoon boat may include at least one pontoon, a deck supported by the at least one pontoon, and a passenger barrier disposed upon and extending in an upward direction from the deck. The passenger barrier may include a fixed portion defining an opening through the passenger barrier, a movable portion operable to selectively close the opening, an opaque panel associated with one or the other of the fixed portion and the movable portion, and a panel comprising a transparent layer associated with one or the other of the fixed portion and the movable portion.

In embodiments, a perforate layer may overlie the transparent layer. The perforate layer may allow vision therethrough from the transparent layer and substantially block vision therethrough toward the transparent layer. A surface of the perforate layer facing away from the transparent layer may be color-matched to the opaque panel. The perforate layer may be disposed on an outward-facing surface of the transparent layer. A surface of the perforate layer facing away from the transparent layer may be color-matched to the opaque panel. A surface of the perforate layer facing the transparent layer may be black. The opaque panel may be associated with the railing, and the transparent layer and the perforate layer may be associated with the gate.

In a further aspect of the present disclosure, a pontoon boat may include at least two pontoons, a deck supported by the at least two pontoons, and a passenger barrier disposed upon and extending in an upward direction from the deck. The passenger barrier may include a railing defining an opening through the passenger barrier, a gate operable to selectively close the opening, an opaque panel associated with one or the other of the railing and the gate, and a panel comprising a transparent layer and a perforate layer associated with one or the other of the railing and the gate. The perforate layer may allow vision therethrough from the transparent layer and substantially block vision therethrough toward the transparent layer. A surface of the perforate layer facing away from the transparent layer may be color-matched to the opaque panel. The perforate layer may be disposed on an outward-facing surface of the transparent layer. The opaque panel may be associated with the railing. The panel comprising the transparent layer and the perforate layer overlying the transparent and generally imperforate panel may be associated with the gate. The perforate layer may include an imperforate portion having a first area and a perforate portion having a second area wherein the second area is about 40% of the first area plus the second area.

DETAILED DESCRIPTION OF THE DRAWINGS

Figure 1:
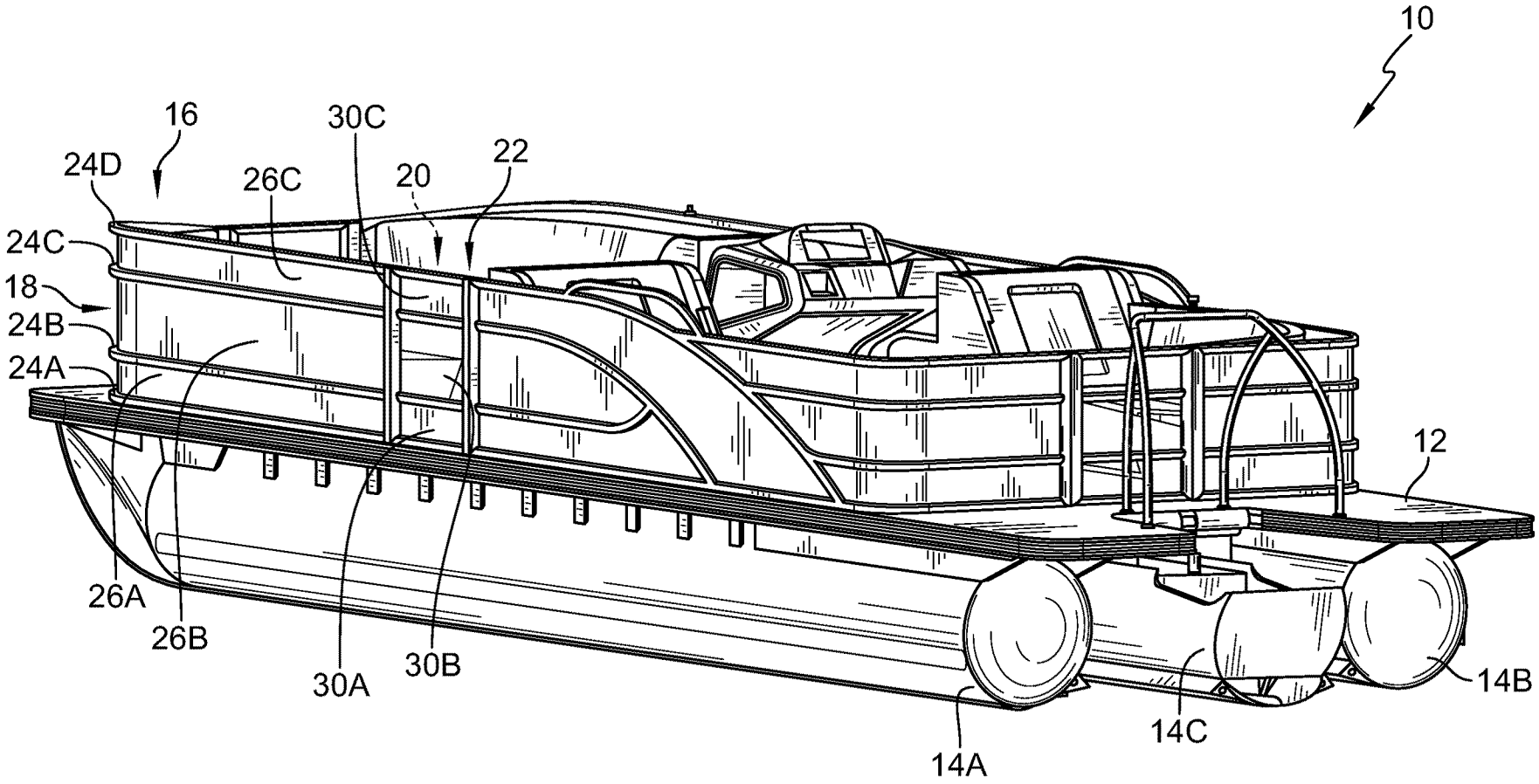
FIG. 1 is a perspective view of a pontoon boat including a deck supported by a pair of pontoons and a barrier disposed about the perimeter of the deck, according to the present disclosure.

FIG. 1 shows a pontoon boat 10 including a deck 12 supported by first and second pontoons 14A, 14B. As shown, the pontoon boat 10 also may include a third pontoon 14C disposed between the first and second pontoons 14A, 14B. The pontoon boat 10 further includes a passenger barrier 16 disposed about a peripheral portion of the deck 12.

The barrier 16 includes a plurality of fixed portions (or rails) 18 cooperating to define a plurality of openings 20 therethorugh, and a plurality of gates 22 configured to selectively close the openings 20. Other embodiments may include more or fewer (as few as one) rails 18 than shown, more or fewer (as few as one) openings 20 than shown, and more or fewer (as few as one) gates 22 than shown.

As shown, the gates 22 are hingedly connected to a corresponding rail 16. In other embodiments, any or all of the gates 22 could be configured otherwise to selectively close the corresponding openings 20. For example, without limitation, the gates 18 could be configured to slide laterally with respect to the corresponding openings 20 and adjacent rails 16. In any event, the gates 22 may be latchable or otherwise securable to a corresponding rail 16.

Each of the rails 18 includes a frame 24 and one or more panels 26 supported by the frame 26. For example, FIG. 1 shows the port rail 18 proximate the bow of the pontoon boat 10 as including first, second, and third panels 26A, 26B, 26C arranged vertically with respect to each other and supported by the frame 24. More specifically, the first panel 26A is supported by first and second members 24A, 24B of the frame 24, the second panel 26B is supported by second and third members 24B, 24C of the frame 24, and the third panel 26C is supported by third and fourth members 24C, 24D of the frame 24.

Other rails 18 may include more or fewer frame members 24*x* and panels 26 than shown, and the frame 24 and panels 26 may be arranged in other ways. For example, the port rail 18 proximate the stern of the pontoon boat 10 is shown as having a portion including a single panel 26 sweeping from an upper portion of the rail 18 to a lower portion of the rail 18.

With reference to FIGS. 1-4, each of the gates 22 includes a frame 28 and one or more panels 30 supported by the frame 28. For example, FIG. 1 shows a gate 22 including first, second, and third panels 30A, 30B, 30C arranged vertically with respect to each other and supported by the frame 28. More specifically, the first panel 30A is supported by first and second members 28A, 28B of the frame 30, the second panel 30B is supported by second and third members 28B, 28C of the frame 28, and the third panel 30C is supported by third and fourth members 28C, 28D of the frame 28. As shown, the frame 28 further includes fifth and sixth frame members 28E, 28F perpendicular to and connected to respective first and second ends of the first, second, third, and fourth frame members 28A, 28B, 28C, 28D. As suggested above, one of the fifth and sixth frame members 28E, 28F may be hingedly connected to a corresponding rail 18, for example, to a frame member 24*x*, and the other of the fifth and sixth frame members 28E, 28F may be configured to latch to a corresponding rail 18.

The frames 24, 28 may be made of aluminum or another suitable structural material.

The panels 26, 30 may be made of aluminum, fiberglass, acrylic, Plexiglas or other suitable materials or combinations of materials.

At least one of the panels 26, 30 is configured to allow a user to generally see therethrough in a first direction, while at the same time generally inhibiting a user from seeing therethrough in a second direction, as discussed further below. For example, such a panel 26, 30 may be configured to allow a user to generally see therethrough from the boat 10 to the surroundings about the boat 10, while at the same time generally inhibiting a user from seeing therethrough from the surroundings about the boat 10 to within the boat 10. Although such a panel 26, 30 is configured to generally inhibit a user from seeing therethrough in the second direction, it need not completely preclude a user from seeing therethrough in the second direction. Such panels may be referred to herein for convenience as one-way transparent.

Figure 3:
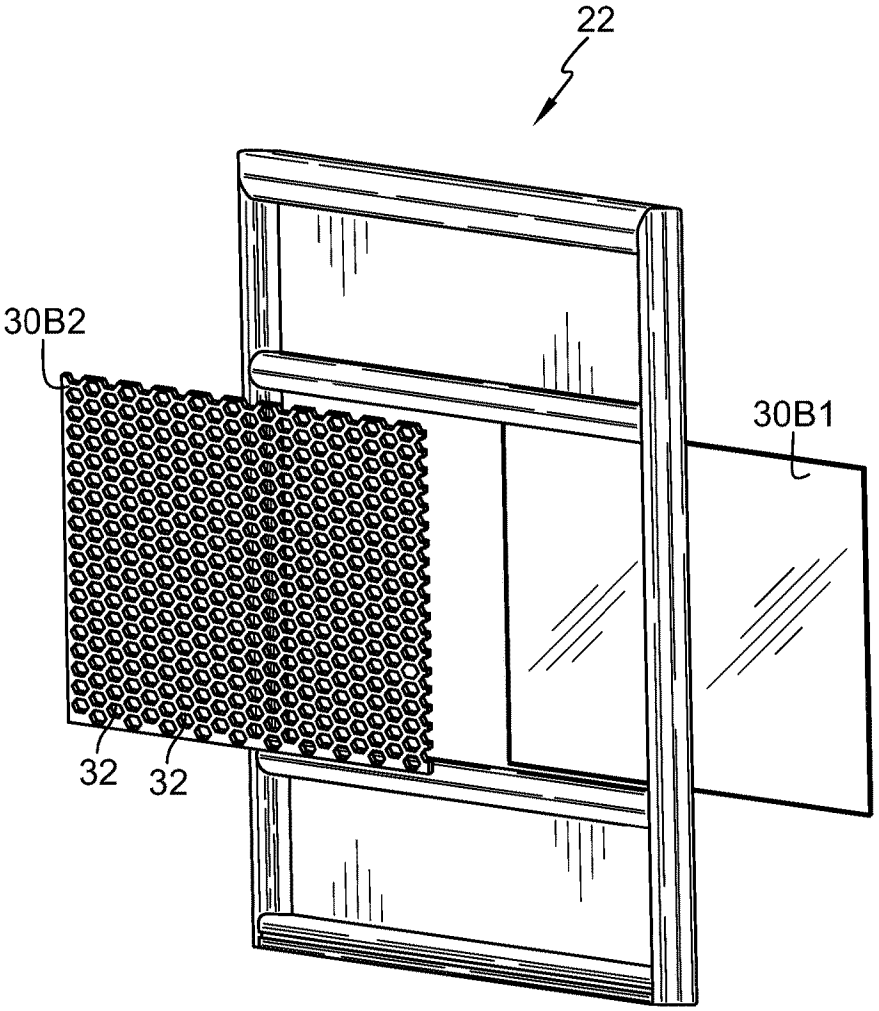
FIG. 3 is an exploded perspective view of the portion of the barrier shown in FIG. 2.
Figure 2:
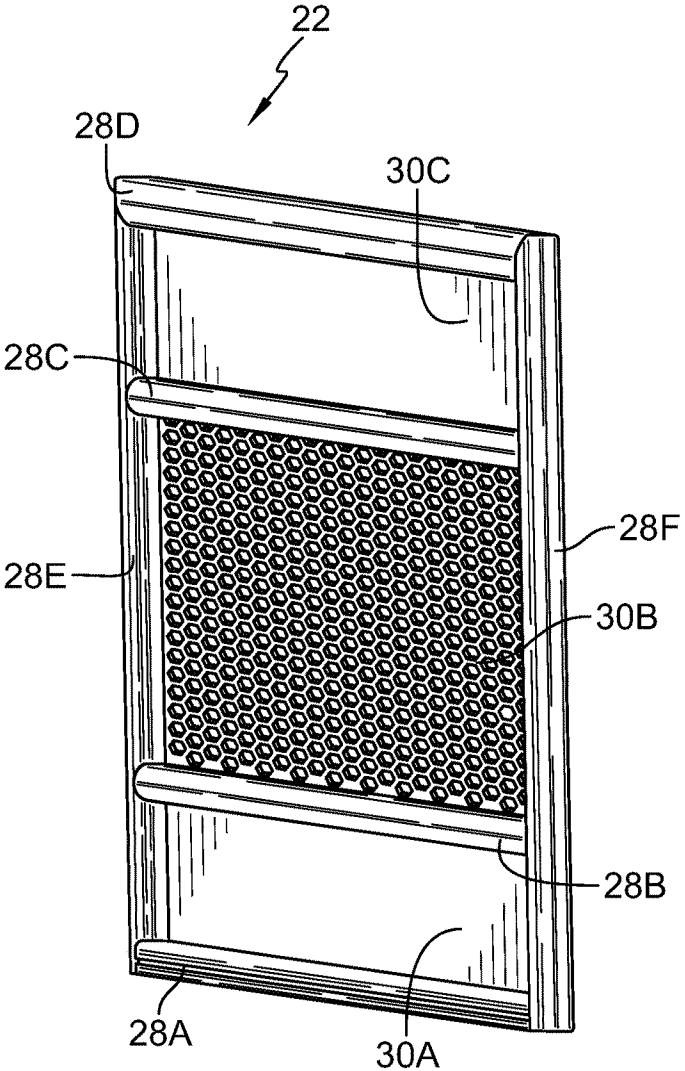
FIG. 2 is a perspective view of a portion of the barrier shown in FIG. 1, the portion of the barrier including a frame and a see-through panel supported by the frame.
Figure 4:
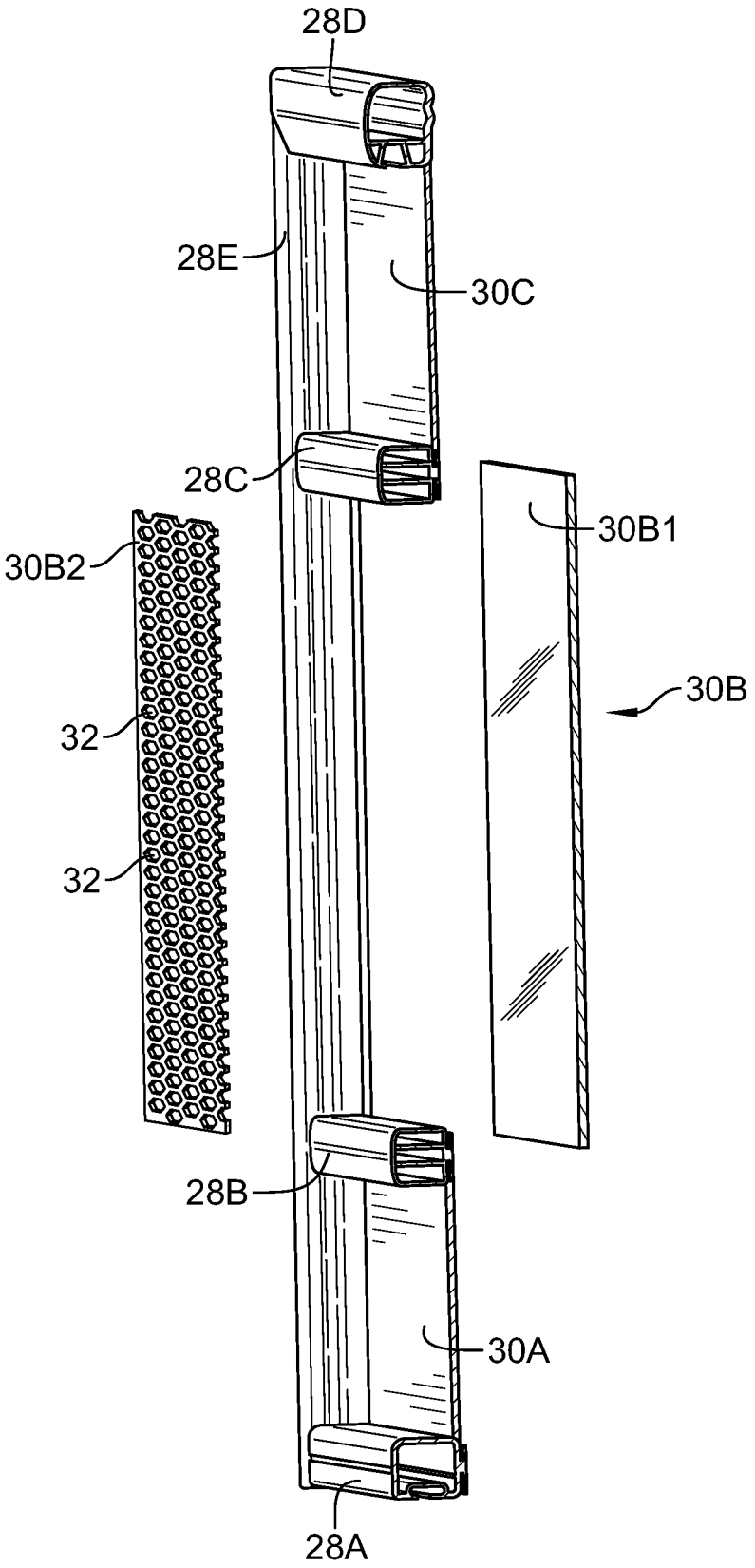
FIG. 4 is an exploded cross-sectional perspective view of the portion of the barrier shown in FIG. 2.

FIGS. 2-4 show an illustrative embodiment of a gate 22 including first, second, and third panels 30A, 30B, 30C supported by a frame 28. As shown, each of the first and third panels 30A, 30C is opaque, and the second panel 30B is one-way transparent. In other embodiments, any of the panels 30 could be opaque and any or all others of the panels 30 could be one-way transparent. For example, the first panel 28A could be one-way transparent and each of the second and third panels 28B, 28C could be opaque; the first and second panels 28A, 28B could be one-way transparent, and the third panel 28C could be opaque; the first and second panels 28A, 28B could be opaque and the third panel 28C could be one-way transparent; or the first and third panels 28A, 28C could be one-way transparent and the second panel 28B could be opaque.

As best shown in FIGS. 3 and 4, the one-way transparent panel 30B is a multi-layer structure including a first layer 30B1 and a second layer 30B2 overlying the first layer 30B1. The first layer 30B1 (sometimes referred to herein as the transparent layer) is a layer of structural, transparent material, for example, acrylic material. The first layer 30B1 may be generally imperforate. The first layer 30B1 may be tinted. For example, the first layer 30B1 may have a smoked appearance.

The second layer 30B2 (sometimes referred to herein as the perforate layer) is a layer of material defining a plurality of perforations 32. The second layer 30B2 (exclusive of the perforations) may be opaque. The second layer 30B2 may be structural or flexible. In an embodiment, the second layer 30B2 may be made of a vinyl material.

The second layer 30B2 may be disposed on the side of the first layer 30B1 facing away from the inside of the pontoon boat 10. The surface of the second layer 30B2 facing away from the first layer 30B1 may be color-matched to the other panels 26, 30 of the pontoon boat 10 or to another feature of the pontoon boat 10. The surface of the second layer 30B2 facing toward the first layer 30B1 may be black or another dark color.

The perforations 32 of the second layer 30B2 are sized and spaced apart so that a user may readily see through the one-way transparent panel 30B when the second layer 30B2 is applied to the first layer 30B1 and installed in the boat 10 as discussed above. In an embodiment, the second layer 30B2 may be embodied as Arlon DPF 45WF one-way transparent vinyl film, which is a PVC film available in a thickness of about 6 mils having perforation 34 sizes of about 0.063 inch and a generally uniform pattern of perforations 34 wherein the perforations 32 define about 40% of the overall area of the second layer 30B2. Put another way, the second layer comprises an imperforate portion having a first area and a perforate portion having a second area wherein the second area is about 40% of the first area plus the second area. Other embodiments may include other perforate structures affording similar optical qualities Other embodiments may use other one-way transparent films or other materials affording one-way transparency through the panel 30B as discussed above.

Although FIGS. 2-4 are described above as showing a gate 30 having a particular one-way transparent gate panel 30B, any or all of the rail panels 26 and gate panels may be embodied as similarly configured one-way transparent panels.

The foregoing description and accompanying drawings are for illustration. Modifications to and variations thereof are contemplated to be covered by the invention defined by the appended claims.

The invention claimed is:

1. A pontoon boat comprising:
at least two pontoons;
a deck supported by the at least two pontoons; and
a passenger barrier disposed upon and extending in an upward direction from the deck, the passenger barrier comprising:
a railing defining an opening through the passenger barrier;
a gate operable to selectively close the opening;
an opaque panel associated with one or the other of the railing and the gate; and
a one-way transparent panel associated with one or the other of the railing and the gate.

2. The pontoon boat of claim 1 wherein the one-way transparent panel comprises a perforate layer overlying a transparent layer.

3. The pontoon boat of claim 2 wherein the perforate layer allows vision therethrough from the transparent layer and substantially blocks vision therethrough toward the transparent layer.

4. The pontoon boat of claim 3 wherein a surface of the perforate opaque layer facing away from the transparent layer is color-matched to the opaque panel.

5. The pontoon boat of claim 2 wherein the perforate layer is disposed on an outward-facing surface of the transparent layer.

6. The pontoon boat of claim 5 wherein the perforate layer comprises an imperforate portion having a first area and a perforate portion having a second area wherein the second area is about 40% of the first area plus the second area.

7. The pontoon boat of claim 6 wherein a surface of the perforate layer facing the transparent layer is black.

8. The pontoon boat of claim 7 wherein a surface of the perforate layer facing away from the transparent layer is color-matched to the opaque panel.

9. The pontoon boat of claim 5,
wherein the opaque panel is associated with the railing, and
wherein the one-way transparent panel is associated with the gate.

10. A pontoon boat comprising:
at least one pontoon;
a deck supported by the at least one pontoon; and
a passenger barrier disposed upon and extending in an upward direction from the deck, the passenger barrier comprising:
a fixed portion defining an opening through the passenger barrier;
a movable portion operable to selectively close the opening;
an opaque panel associated with one or the other of the fixed portion and the movable portion;
a panel comprising a transparent layer associated with one or the other of the fixed portion and the movable portion; and
a perforate layer overlying the transparent layer.

11. The pontoon boat of claim 10 wherein the perforate layer allows vision therethrough from the transparent layer and substantially blocks vision therethrough toward the transparent layer.

12. The pontoon boat of claim 11 wherein a surface of the perforate layer facing away from the transparent layer is color-matched to the opaque panel.

13. The pontoon boat of claim 10 wherein the perforate layer is disposed on an outward-facing surface of the transparent layer.

14. The pontoon boat of claim 13 wherein a surface of the perforate layer facing away from the transparent layer is color-matched to the opaque panel.

15. The pontoon boat of claim 13 wherein a surface of the perforate layer facing the transparent layer is black.

16. The pontoon boat of claim 13,
wherein the opaque panel is associated with the fixed portion, and
wherein the transparent layer and the perforate layer are associated with the movable portion.

17. A pontoon boat comprising:
at least two pontoons;
a deck supported by the at least two pontoons; and
a passenger barrier disposed upon and extending in an upward direction from the deck, the passenger barrier comprising:
a railing defining an opening through the passenger barrier;
a gate operable to selectively close the opening;
an opaque panel associated with one or the other of the railing and the gate; and
a panel comprising a transparent layer and a perforate layer associated with one or the other of the railing and the gate,
wherein the perforate layer allows vision therethrough from the transparent layer and substantially blocks vision therethrough toward the transparent layer,
wherein a surface of the perforate layer facing away from the transparent layer is color-matched to the opaque panel, and
wherein the perforate layer is disposed on an outward-facing surface of the transparent layer.

18. The pontoon boat of claim 17 wherein the opaque panel is associated with the railing, and
wherein the panel comprising the transparent layer and the perforate layer overlying the transparent and generally imperforate panel is associated with the gate.

19. The pontoon boat of claim 17 wherein the perforate layer comprises an imperforate portion having a first area and a perforate portion having a second area wherein the second area is about 40% of the first area plus the second area.

* * * * *